US009861137B2

(12) United States Patent
Liu

(10) Patent No.: US 9,861,137 B2
(45) Date of Patent: Jan. 9, 2018

(54) ELECTRONIC CIGARETTE

(71) Applicant: HUIZHOU KIMREE TECHNOLOGY CO., LTD, Huizhou, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen, Guangdong (CN)

( * ) Notice: Subject to any disclaimer, the term of this patent is extended or adjusted under 35 U.S.C. 154(b) by 289 days.

(21) Appl. No.: 14/809,621

(22) Filed: Jul. 27, 2015

(65) Prior Publication Data

US 2016/0058074 A1 Mar. 3, 2016

Related U.S. Application Data

(63) Continuation of application No. PCT/CN2014/085735, filed on Sep. 2, 2014.

(51) Int. Cl.
*A24F 47/00* (2006.01)
*H05B 1/02* (2006.01)
*A44C 5/00* (2006.01)

(52) U.S. Cl.
CPC ..... *A24F 47/008* (2013.01); *H05B 1/0244* (2013.01); *A44C 5/0007* (2013.01)

(58) Field of Classification Search
CPC ..... A24F 47/008; A24F 47/002; A61M 15/06; A44C 5/0007; A61B 5/681; A45F 2005/008; H05B 1/0244
See application file for complete search history.

(56) References Cited

U.S. PATENT DOCUMENTS 4,265,236 A * 5/1981 Pacella ..... A61M 15/08 128/202.13
8,301,211 B2 * 10/2012 Lee ..... H04M 1/274525 340/539.11
8,784,271 B2 * 7/2014 Brumback ..... 340/870.16
2007/0267031 A1 * 11/2007 Hon ..... A24F 47/008 131/273

(Continued)

OTHER PUBLICATIONS

International Written Opinion of PCT/CN2014/085735 dated Jan. 6, 2015.*

*Primary Examiner* — Jerzi H Moreno Hernandez
(74) *Attorney, Agent, or Firm* — U.S. Fairsky LLP; Yue Xu

(57) ABSTRACT

An electronic cigarette is provided according to the present application, which includes an annular body. The annular body includes an atomizer assembly, a power supply assembly, a connecting block, a first arc-shaped segment and a second arc-shaped segment. An accommodating chamber is provided in the first arc-shaped segment, and a first electrode connector electrically connected to the power supply assembly is provided in the first arc-shaped segment. The atomizer assembly includes an atomizing sleeve, a second electrode connector, a liquid accommodating space arranged in the atomizing sleeve and an electric heating wire assembly. The electronic cigarette may be worn on the wrist of the user securely, which can avoid falling of the electronic cigarette, and avoid unnecessary loss. Further, may the electronic cigarette can be conveniently carried by wearing it on the wrist, thus the user may puff on the electronic cigarette anytime and anywhere.

20 Claims, 9 Drawing Sheets

(56) References Cited

U.S. PATENT DOCUMENTS

| | | | | |
|---|---|---|---|---|
| 2012/0138637 | A1* | 6/2012 | Ciavarella | A44C 5/0023 222/175 |
| 2013/0284192 | A1* | 10/2013 | Peleg | A24F 47/002 131/329 |
| 2014/0158793 | A1* | 6/2014 | Sims, Sr. | B05B 15/061 239/152 |
| 2014/0378794 | A1* | 12/2014 | Conrad | A61B 5/681 600/317 |
| 2015/0164142 | A1* | 6/2015 | Li | A24F 47/008 131/329 |
| 2015/0181930 | A1* | 7/2015 | Liu | A24F 47/008 131/329 |
| 2015/0189976 | A1* | 7/2015 | Lee | A45F 5/00 224/267 |
| 2015/0264978 | A1* | 9/2015 | Arnel | A24F 47/002 131/329 |

* cited by examiner

ELECTRONIC CIGARETTE

CROSS-REFERENCE TO RELATED APPLICATIONS

This application is a continuation under 35 U.S.C. §120 of PCT/CN2014/085735, filed Sep. 2, 2014, the entire content of which is incorporated herein by reference.

TECHNICAL FIELD

The present application relates to the technical field of electronic cigarettes, and particularly to an electronic cigarette which is portable and can be smoked by a user at any time.

BACKGROUND

The overall shape of an electronic cigarette in the conventional technology simulates the appearance of a real cigarette, and the electronic cigarette is generally placed in a specific electronic cigarette case to be carried.

The overall structure of the electronic cigarette case in the conventional technology is relatively large, therefore the electronic cigarette is inconvenient to carry, which increases burden for the user to carry the electronic cigarette. Further, if a user wants to smoke, the user needs to take the electronic cigarette out of the electronic cigarette case, which increases inconvenience in the smoking process of the user. Further, if the user forgets to carry the electronic cigarette, the user can not smoke, thus the user cannot smoke anytime and anywhere as desired. In addition, the electronic cigarette in the conventional technology can only generate smoke to be inhaled by the user and cannot achieve other functions. Due to the single function of the electronic cigarette, the diversified requirements of the users cannot be met.

SUMMARY

An electronic cigarette is provided according to the present application, which is portable and has various functions.

An electronic cigarette is provided, which includes an annular body configured to be worn on the wrist of a user. The annular body includes an atomizer assembly, a power supply assembly, a connecting block, a first arc-shaped segment and a second arc-shaped segment which are arranged respectively at two ends of the connecting block and are configured to undergo elastic deformation under the action of an external force, and the connecting block is provided with a display module. An accommodating chamber in communication with an end surface of the first arc-shaped segment is provided in the first arc-shaped segment, a first electrode connector electrically connected to the power supply assembly is provided in the first arc-shaped segment, the atomizer assembly and the first electrode connector are detachably connected to each other, and the atomizer assembly is inserted in an accommodating chamber of the first arc-shaped segment with a gap between the accommodating chamber and the atomizer assembly, the first electrode connector is inserted in the accommodating chamber of the first arc-shaped segment with a gap between the accommodating chamber and the first electrode connector, and the first electrode connector and the atomizer assembly are sequentially arranged in an extending direction of the first arc-shaped segment. The atomizer assembly includes an atomizing sleeve, a second electrode connector arranged at an end of the atomizing sleeve and electrically connected to the first electrode connector, a liquid accommodating space arranged in the atomizing sleeve, and an electric heating wire assembly configured to atomize cigarette liquid in the liquid accommodating space to form smoke, and the electric heating wire assembly is electrically connected to the second electrode connector In the electronic cigarette, the first electrode connector is detachably accommodated in the accommodating chamber of the first arc-shaped segment, and the first electrode connector is electrically connected to the power supply assembly via a lead curled and received in the accommodating chamber of the first arc-shaped segment, to allow the first electrode connector to be removable from the accommodating chamber of the first arc-shaped segment together with the atomizer assembly. An airflow sensing control module is provided in the first electrode connector, and is configured to control the power supply assembly to supply power to the atomizer assembly in the case that it is sensed by the airflow sensing control module that the user is puffing on the electronic cigarette.

In the electronic cigarette, an end of the first arc-shaped segment away from the connecting block is provided with a first end cap, and the first end cap is detachably connected to the first arc-shaped segment. An end of the atomizer assembly away from the second electrode connector is provided with a suction nozzle for inhaling smoke, an end of the atomizer assembly provided with the suction nozzle extends out of the accommodating chamber of the first arc-shaped segment, and the suction nozzle is received in the first end cap.

In the electronic cigarette, the atomizer assembly further includes an air tube, the air tube is inserted into the atomizing sleeve with a gap between the air tube and the atomizing sleeve, and is configured to allow the smoke to flow through, and an end of the air tube close to the suction nozzle is in communication with an outer surface of the suction nozzle. The liquid accommodating space is located between the atomizing sleeve and the air tube. An atomizing chamber is arranged at a side of the second electrode connector in a direction towards the suction nozzle, the electric heating wire assembly is received in the atomizing chamber, and the atomizing chamber is in communication with the air tube.

In the electronic cigarette, the first electrode connector includes a first outer electrode, a first insulating ring inserted in the first outer electrode and a first inner electrode inserted in the first insulating ring. The second electrode connector includes a second outer electrode, a second insulating ring inserted in the second outer electrode, and a second inner electrode inserted in the second insulating ring. Each of the first outer electrode and the second outer electrode is made of a magnetic material or is provided with a respective magnetic block, and the first outer electrode and the second outer electrode magnetically repel each other, to allow the first outer electrode to be subjected to a force in a direction away from the first arc-shaped segment in the case that the first end cap is disengaged from the first arc-shaped segment, to allow the atomizer assembly to be disengaged from the first arc-shaped segment. Or, each of the first inner electrode and the second inner electrode is made of a magnetic material or is provided with a respective magnetic block, and the first inner electrode and the second inner electrode magnetically repel each other, to allow the first inner electrode to be subjected to a force in a direction away from the first arc-shaped segment in the case that the first end cap is disengaged from the first arc-shaped segment, to allow the atomizer assembly to be disengaged from the first arc-shaped segment.

In the electronic cigarette, the first arc-shaped segment is made of a deformable material, and is configured to be bent to form any angle according to an operation of the user when the user smokes.

In the electronic cigarette, the air tube includes a plurality of sub air tubes, which has sequentially decreased diameters and are nested into one another, and hollow portions of all the sub air tubes are in communication with each other, to allow adjacent two sub air tubes to be movable with respect to each other in an axial direction of the sub air tubes. Respective ends of adjacent two sub air tubes are configured to be connected, and in two interconnected sub air tubes, the sub air tube with a large diameter is a first target sub air tube, and the sub air tube with a small diameter is a second target sub air tube. A first flange is provided at an end, configured to be connected to the second target sub air tube, of the first target sub air tube, and the first flange extends along a radial direction of the first target sub air tube towards the interior of the first target sub air tube. An end, configured to be connected to the first target sub air tube, of the second target sub air tube is provided with a second flange, the second flange extends in a radial direction of the second target sub air tube towards the interior of the second target sub air tube, and the second flange is configured to abut against the first flange in the case that the second target sub air tube moves in the axial direction of the first target sub air tube and in a direction away from the first arc-shaped segment, to connect respective ends of the first target sub air tube and the second target sub air tube.

In the electronic cigarette, the connecting block is provided with an upper cover and a lower cover cooperating with each other, and the upper cover and the lower cover are configured to be combined to form an accommodating chamber of the connecting block. A first control module is provided in the accommodating chamber of the connecting block, and the first control module is electrically connected to the display module. A through hole configured to receive the display module is provided in the upper cover at a position corresponding to the display module. A sensor and a wireless communication module are arranged in the accommodating chamber of the connecting block and are electrically connected to the first control module. The sensor is configured to acquire a parameter, and the first control module is configured to transmit the parameter acquired by the sensor to a mobile terminal by the wireless communication module.

In the electronic cigarette, the sensor is an acceleration sensor, and/or an electrocardiogram examination sensor, and/or a body temperature sensor. The first control module is configured to acquire a parameter acquired by the acceleration sensor, and/or the electrocardiogram examination sensor, and/or the body temperature sensor, and the first control module is further configured to enable the display module to display the parameter. The wireless communication module is a Bluetooth module for establishing a Bluetooth connection with the mobile terminal, and/or a wireless fidelity (WIFI) module for establishing a WIFI connection with the mobile terminal, and/or a near field communication (NFC) module for establishing an NFC connection with the mobile terminal.

In the electronic cigarette, an end of the second arc-shaped segment away from the connecting block is provided with a second end cap, and the second end cap is detachably connected to the second arc-shaped segment; a second control module is provided in an accommodating chamber of the second arc-shaped segment, and a universal serial bus (USB) interface is provided and is electrically connected to the second control module. The second end cap is provided with a through hole for receiving the USB interface. The second control module is electrically connected to the first control module, and is configured to acquire, via the first control module, the parameter acquired by the sensor, and the second control module is connected to the mobile terminal via the USB interface and a data line, to allow the second control module to transmit the acquired parameter to the mobile terminal via the USB interface and the data line; and/or, the second control module is electrically connected to the power supply assembly, and the second control module is electrically connected to an external power supply via the USB interface and the data line, to allow the second control module to enable the external power supply to charge the power supply assembly.

In the electronic cigarette, the power supply assembly is a lithium power supply, and is arranged in an accommodating chamber of the connecting block; or, a holder is provided in an accommodating chamber of the second arc-shaped segment, and the power supply assembly is fixedly arranged in the accommodating chamber of the second arc-shaped segment via the holder.

In the electronic cigarette, a first control module is provided in the accommodating chamber of the connecting block, and is electrically connected to the display module. The first control nodule is further electrically connected to the power supply assembly, and is further configured to acquire a residual capacity of the power supply assembly, and the first control module is configured to enable the display module to display the residual capacity.

In the electronic cigarette, the electronic cigarette is further provided with a first control module, and the first control module is electrically connected to the display module and the airflow sensing control module, the first control module is configured to control the display module to display the number of times of the user sucking the electronic cigarette, or/and an atomizing power of the atomizer assembly, or/and a smoking time of the user, or/and a smoking pattern graph.

In the electronic cigarette, an end of the first arc-shaped segment away from the connecting block is provided with a first magnet, and an end of the second arc-shaped segment away from the connecting block is provided with a second magnet configured to be connected to the first magnet by magnetic attraction, to allow the electronic cigarette to be worn on the wrist of the user or removed from the wrist of the user by the detachable connection between the first magnet and the second magnet.

In the electronic cigarette, in the case that the electronic cigarette is worn on the wrist of the user, the end of the first arc-shaped segment away from the connecting block and the end of the second arc-shaped segment away from the connecting block are in parallel with each other and are fitting close to the wrist of the user.

In the electronic cigarette, in the case that the electronic cigarette is worn on the wrist of the user, an end surface of the end of the first arc-shaped segment away from the connecting block abuts against an end surface of the end of the second arc-shaped segment away from the connecting block, or, a side surface, perpendicular to an extending direction of the hand, of the end of the first arc-shaped segment away from the connecting block abuts against a side surface, perpendicular to the extending direction of the hand, of the end of the second arc-shaped segment away from the connecting block.

In the electronic cigarette, the second electrode connector includes a second outer electrode, a second insulating ring inserted in the second outer electrode, and a second inner electrode inserted in the second insulating ring, the electric heating wire assembly is electrically connected to the second outer electrode and the second inner electrode, and the electric heating wire assembly is received in an atomizing chamber enclosed by the second outer electrode. An end of the second outer electrode located inside the atomizing sleeve is provided with two fixing grooves at opposite positions extending along an axial direction of the second outer electrode, each of the fixing grooves extends to an end surface and a side surface of the second outer electrode and is in communication with the liquid accommodating space, and an annular protrusion is provided on an outer peripheral surface of the second outer electrode in a radial direction at a position corresponding to a bottom wall of the fixing groove. Two ends of the electric heating wire assembly are respectively inserted in the fixing grooves, and a fixing cap is sleeved on an end of the second inner electrode located inside the atomizing sleeve and has an end configured to abut against the protrusion, an end surface of the fixing cap is configured to abut against an end of the electric heating wire assembly, and a portion of the protrusion located outside the bottom wall of the fixing groove is configured to abut against the end of the electric heating wire assembly.

An electronic cigarette is provided according to the present application, includes an annular body, the annular body includes an atomizer assembly, a power supply assembly, a connecting block, a first arc-shaped segment and a second arc-shaped segment. An accommodating chamber in communication with an end surface of the first arc-shaped segment is provided in the first arc-shaped segment. A first electrode connector electrically connected to the power supply assembly is provided in the first arc-shaped segment. The atomizer assembly and the first electrode connector are detachably connected to each other, and the atomizer assembly is inserted in the accommodating chamber of the first arc-shaped segment with a gap between the accommodating chamber and the atomizer assembly, the first electrode connector is inserted in the accommodating chamber of the first arc-shaped segment with a gap between the accommodating chamber and the first electrode connector. The atomizer assembly includes an atomizing sleeve, a second electrode connector arranged at an end of the atomizing sleeve and electrically connected to the first electrode connector, a liquid accommodating space arranged in the atomizing sleeve and an electric heating wire assembly configured to atomize liquid in the liquid accommodating space to form smoke. The electric heating wire assembly is electrically connected to the second electrode connector. The electronic cigarette can match the wrists of different users, and may be firmly worn on the user's wrist, thereby avoiding the falling of the electronic cigarette, and avoiding unnecessary loss. In addition, the electronic cigarette may be worn on the wrist of the user, thus can be carried easily without being placed in an electronic cigarette casing, and greatly reduces the probability that the user forgets to carry the electronic cigarette, and the user can puff on the electronic cigarette anytime and anywhere. In addition, the atomizer assembly and the first arc-shaped segment are detachably connected, which facilitates the user puffing on the electronic cigarette anytime and replacing the atomizer assembly anytime, and avoid unnecessary waste caused by replacing the whole electronic cigarette when the atomizer assembly is damaged.

DETAILED DESCRIPTION

An electronic cigarette is provided according to a first embodiment, which can be worn on the wrist of a user.

Figure 1:
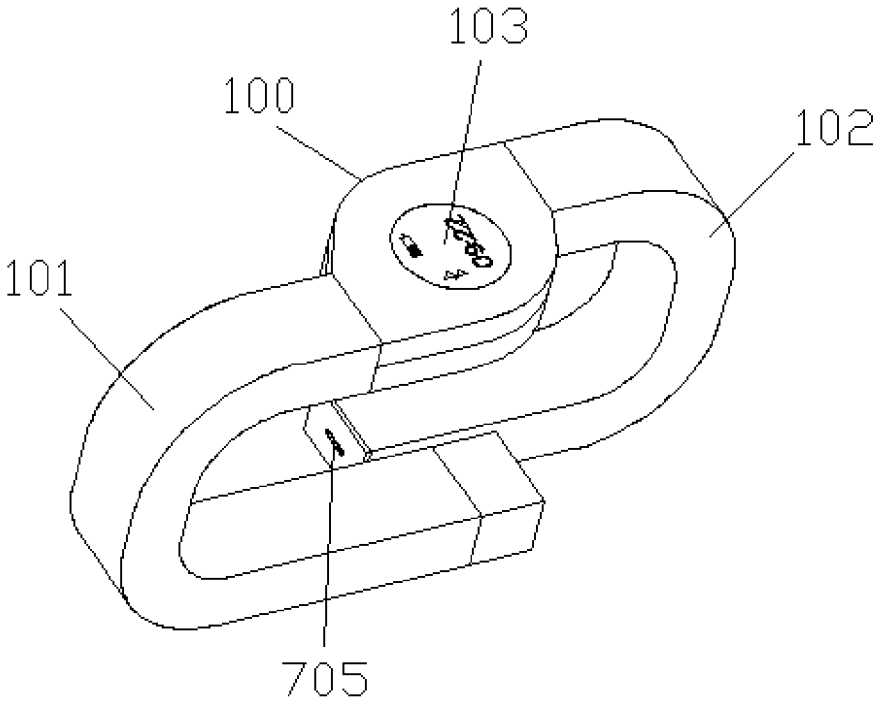
FIG. 1 is a schematic view showing the overall structure of a preferred embodiment of an electronic cigarette according to the present application.

The overall structure of the electronic cigarette according to this embodiment is described in detail in conjunction with FIG. 1.

As shown in FIG. 1, the electronic cigarette includes an annular body which can be worn on the wrist of a user. The annular body includes a connecting block 100, a first arc-shaped segment 101 and a second arc-shaped segment 102 which are arranged respectively at two ends of the connecting block 100 and are configured to undergo elastic deformation under the action of an external force.

Due to the connecting block 100, the first arc-shaped segment 101 and the second arc-shaped segment 102 configured to undergo elastic deformation under the external force, the electronic cigarette can match the wrists of different users, and may be firmly worn on the user's wrist, thereby avoiding the falling of the electronic cigarette, and avoiding unnecessary loss. In addition, the electronic cigarette may be worn on the wrist of the user, thus can be carried easily without being placed in an electronic cigarette casing, and greatly reduces the probability that the user forgets to carry the electronic cigarette, and the user can puff on the electronic cigarette anytime and anywhere. Further, since the electronic cigarette can undergo elastic deformation, it may be unfurled when being sold or/and being presented, therefore the above arc-shaped or annular shape is only the shape of the electronic cigarette in this embodiment when being worn on the user's wrist.

Furthermore, since the electronic cigarette according to this embodiment is configured to match the shape of the user's wrist, the bracelet-shaped electronic cigarette is less likely to fall off when being worn by the user, which effectively ensures the security of the electronic cigarette, and prevents the situation that the service life of the electronic cigarette is reduced due to accidental fall of the electronic cigarette, and the user may carry the electronic cigarette in daily life or during exercise, to allow the user to smoke anytime and anywhere.

An atomizer assembly for atomizing the cigarette liquid to generate smoke and a power supply assembly for supplying power to the atomizer assembly are further provided inside the annular body.

Further, the connecting block 100 is provided with a display module 103, and the display module 103 may display various parameters according to the requirements of the user. The specific parameter which may be displayed by the display module 103 is not limited.

Figure 2:
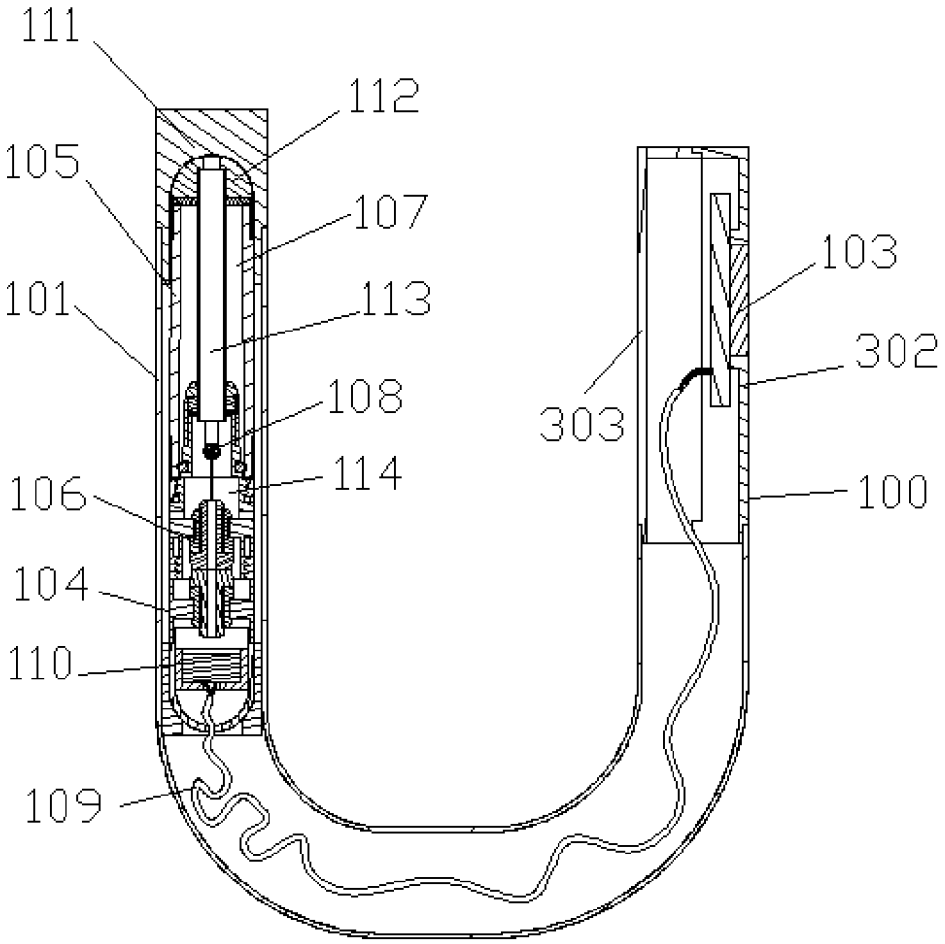
FIG. 2 is a schematic partially sectional view showing the structure of a preferred embodiment of the electronic cigarette according to the present application.
Figure 3:
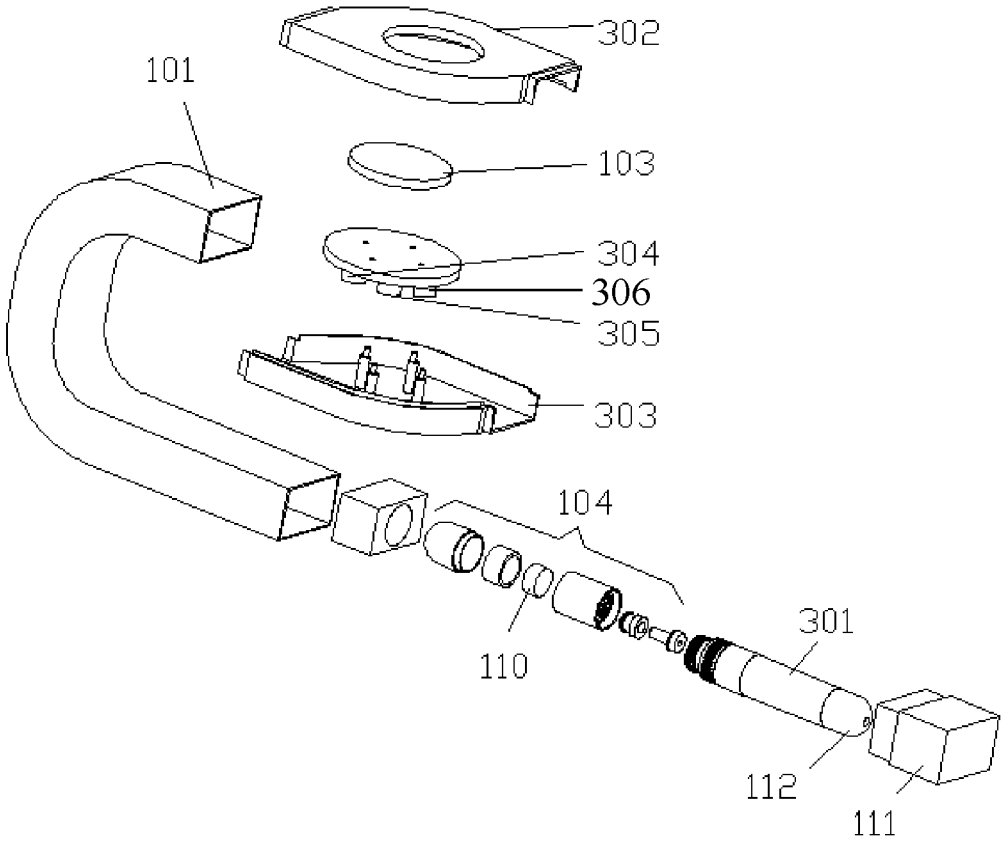
FIG. 3 is a schematic partially exploded view showing the structure of a preferred embodiment of the electronic cigarette according to the present application.

Reference is made to FIGS. 2 and 3 hereinafter, FIG. 2 is a schematic sectional view showing the structure of the first arc-shaped segment 101 and the connecting block 100, and FIG. 3 is a schematic exploded view showing the structure of the first arc-shaped segment 101 and the connecting block 100.

An accommodating chamber in communication with an end surface of the first arc-shaped segment 101 is provided inside the first arc-shaped segment 101.

A first electrode connector 104 electrically connected to the power supply assembly is provided inside the accommodating chamber.

The atomizer assembly 301 and the first electrode connector 104 are detachably connected.

A manner for detachably connecting the atomizer assembly 301 to the first electrode connector 104 is not limited in this embodiment, as long as it can realize the free disassembly and assembly of the atomizer assembly 301 and the first electrode connector 104. For example, a threaded segment is provided at an end, connected to the first electrode connector 104, of the atomizer assembly 301, a threaded segment is provided at an end, connected to the atomizer assembly 301, of the first electrode connector 104, and the threaded segment of the atomizer assembly 301 matches with the threaded segment of the first electrode connector 104, thus the threaded segment on the atomizer assembly 301 can be screwed with the threaded segment on the first electrode connector 104, to detachably connect the atomizer assembly 301 to the first electrode connector 104. Apparently, the detachable connection between the atomizer assembly 301 and the first electrode connector 104 may also be realized by a snap-fit connection or a magnet, and etc., which is not limited herein.

Further, the atomizer assembly 301 is inserted in the accommodating chamber with a gap therebetween, and the first electrode connector 104 is also inserted in the accommodating chamber with a gap therebetween. The first electrode connector 104 and the atomizer assembly 301 are sequentially arranged in the extending direction of the first arc-shaped segment 101.

Since each of the atomizer assembly 301 and the first electrode connector 104 is inserted in the accommodating chamber with a gap therebetween, the user may conveniently remove the atomizer assembly 301 together with the first electrode connector 104 from the first arc-shaped segment 101 at any time, to allow the user to smoke conveniently by the atomizer assembly 301.

When the atomizer assembly 301 breaks down or the cigarette liquid stored in the atomizer assembly 301 is insufficient, it is required to replace the atomizer assembly 301 or add cigarette liquid into the atomizer assembly 301, and since the atomizer assembly 301 is inserted in the accommodating chamber of the first arc-shaped segment 101 with a gap therebetween, the user may remove the atomizer assembly 301 from the accommodating chamber at any time to replace the atomizer assembly or add cigarette liquid. Apparently, the first electrode connector 104 may also be non-detachably fixed inside the first arc-shaped segment 101, which is not limited herein.

Further, reference is made to FIG. 2. The atomizer assembly 301 includes an atomizing sleeve 105, a second electrode connector 106, a liquid accommodating space 107, and an electric heating wire assembly 108.

Various components of the atomizer assembly 301 are arranged inside the atomizing sleeve 105, and the atomizing sleeve 105 is inserted in the accommodating chamber of the first arc-shaped segment 101 with a gap therebetween, thus the object of inserting the atomizer assembly 301 in the accommodating chamber of the first arc-shaped segment 101 with a gap therebetween may be achieved.

The second electrode connector 106 is arranged at an end of the atomizing sleeve 105 and is electrically connected to the first electrode connector 104.

Since the first electrode connector 104 is electrically connected to the power supply assembly, and the first electrode connector 104 is also electrically connected to the second electrode connector 106, the power supply assembly can supply power to the atomizer assembly 301 via the first electrode connector 104 and the second electrode connector 106.

The liquid accommodating space 107 is arranged inside the atomizing sleeve 105. In the electronic cigarette according to this embodiment, the cigarette liquid can be directly added into the liquid accommodating space 107, to increase the amount of cigarette liquid stored in the electronic cigarette, and to effectively ensure the duration of the user smoking the electronic cigarette. Alternatively, a liquid storage cotton containing cigarette liquid is placed inside the liquid accommodating space 107, thus preventing the cigarette liquid from being excessively delivered and reducing the leakage of the cigarette liquid.

The electric heating wire assembly 108 is arranged in the atomizing sleeve 105 and configured to atomize the cigarette liquid in the liquid accommodating space 107 to form smoke. The electric heating wire assembly 108 is electrically connected to the second electrode connector 106.

That is, the power supply assembly supplies power to the electric heating wire assembly 108 via the first electrode connector 104 and the second electrode connector 106, to allow the electric heating wire assembly 108 to atomize the cigarette liquid to form smoke.

In this embodiment, the liquid accommodating space 107 and the electric heating wire assembly 108 are both arranged in the same atomizing sleeve 105, and an end of the liquid accommodating space 107 is arranged to surround the periphery of the electric heating wire assembly 108. Apparently, the atomizing sleeve 105 may also be formed by two sub-sleeves which are detachably connected to each other, one of the two sub-sleeves is configured to store cigarette liquid and the other sub-sleeve is configured to accommodate the electric heating wire assembly 108 and fix the second electrode connector 106. Therefore, the structure of the atomizer assembly is not limited herein.

Furthermore, for allowing the electronic cigarette to be worn on the wrist of the user reliably, a first magnet (not shown) is preferably provided at an end of the first arc-shaped segment 101 away from the connecting block 100, and a second magnet (not shown) configured to be connected to the first magnet by magnetic attraction is preferably provided at an end of the second arc-shaped segment 102 away from the connecting block 100, therefore the electronic cigarette can be wore on the wrist of the user reliably or conveniently removed from the wrist of the user by the detachable connection between the first magnet and the second magnet. The first magnet and the second magnet may be made of material such as magnet or iron. Apparently, the connection method between the end of the first arc-shaped segment 101 away from the connecting block 100 and the end of the second arc-shaped segment 102 away from the connecting block 100 may also be implemented by bonding or snap-fit connection, which is not limited herein.

In this embodiment, when the electronic cigarette is worn on the wrist of the user, the end of the first arc-shaped segment 101 away from the connecting block 100 and the end of the second arc-shaped segment 102 away from the connecting block 100 are arranged in parallel with each other and both fit close to the wrist. A side surface, perpendicular to the extending direction of the hand, of the end of the first arc-shaped segment 101 away from the connecting block 100 and a side surface, perpendicular to the extending direction of the hand, of the end of the second arc-shaped segment 102 away from the connecting block abut against each other and are connected to each other by the magnetic force. Since the first arc-shaped segment 101 and the second arc-shaped segment 102 are fitting close to the wrist, the electronic cigarette can be reliably worn on the wrist of the user, and the user can wear it more comfortable. Apparently, in another solution, an end surface of the end of the first arc-shaped segment 101 away from the connecting block 100 and an end surface of the end of the second arc-shaped segment 102 away from the connecting block 100 are configured to abut against each other, and the specific manner is not limited herein.

The specific structure of the electronic cigarette in a second embodiment is described in detail.

Figure 4:
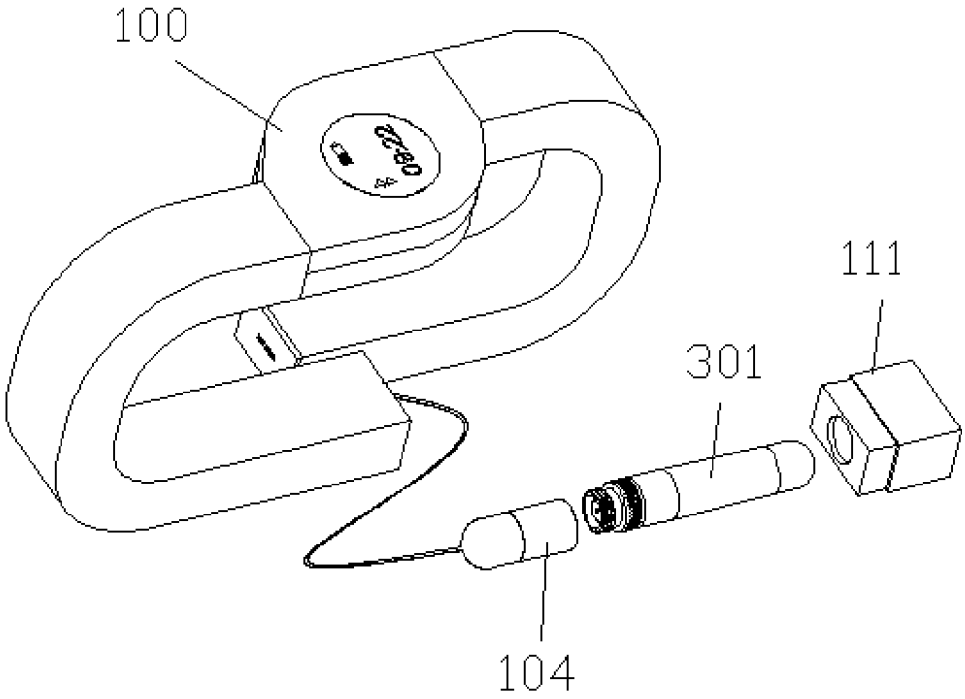
FIG. 4 is a schematic view showing the structure of a preferred embodiment of the electronic cigarette according to the present application, wherein an atomizer assembly and a first electrode connector are taken out of an accommodating chamber.

Referring to FIGS. 2 and 4 again, the first electrode connector 104 is electrically connected to the power supply assembly via a lead 109 curled and received in the accommodating chamber of the first arc-shaped segment 101, thus the first electrode connector 104 can be removed from the accommodating chamber together with the atomizer assembly 301.

The specific position of the power supply assembly is not limited in this embodiment, as long as the power supply assembly can be electrically connected to the atomizer assembly 301.

The lead 109 is received inside the first arc-shaped segment 101 in a curled state, thus the electric connection relationship between the atomizer assembly 301 and the power supply assembly may still be maintained when the atomizer assembly 301 is removed from the accommodating chamber of the first arc-shaped segment 101, thereby ensuring that the power supply assembly can still supply power to the atomizer assembly 301.

That is, in practical application, the user may remove the atomizer assembly 301 from the accommodating chamber of the first arc-shaped segment 101 if the user desires to smoke, when the user sucks the atomizer assembly 301, the power supply assembly supplies power to the atomizer assembly 301 via the lead 109, to ensure that the atomizer assembly 301 can atomize the cigarette liquid to form smoke which can be inhaled by the user.

Specifically, as shown in FIGS. 2 and 3, an airflow sensing control module 110 is provided in the first electrode connector 104, and the airflow sensing control module 110 is configured to control the power supply assembly to supply power to the atomizer assembly 301 when it is sensed that the user is puffing on the electronic cigarette.

Figure 12:
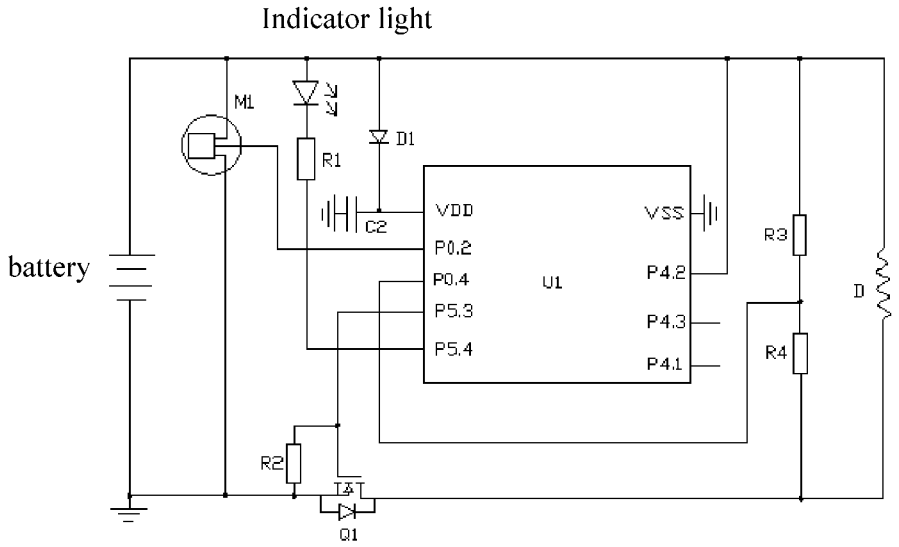
FIG. 12 is a circuit diagram of a preferred embodiment of an electronic cigarette according to the present application, wherein an airflow sensing control module, a power supply assembly and an atomizer assembly are connected.

Specifically, as shown in FIG. 12, the airflow sensing control module 110 is provided with an airflow sensor M1 with a model number of S087, and a control chip U1 with a model number of SN8P2711B, and the control chip U1 is configured to control an electric heating wire D of the electric heating wire assembly in the atomizer assembly 301 according to a triggering signal of the airflow sensor M1 to atomize the cigarette liquid. The operation process of the above circuit is described in detail hereinafter. When a user smokes, the airflow sensor M1 transmits a smoking signal to the control chip U1, and the control chip U1 controls a field effect transistor Q1 in a switch assembly to be switched on, to allow the battery in the power supply assembly to supply power to the electric heating wire D of the atomizer assembly 301 and to allow the electric heating wire D to atomize the cigarette liquid, and meanwhile control a switch indicator light to be turned on. That is, when the user sucks the atomizer assembly 301, the air pressure inside the atomizer assembly 301 may be reduced, and when it is detected by the airflow sensing control module 110 that the air pressure inside the atomizer assembly 301 is reduced, the airflow sensing control module 110 generates a triggering signal correspondingly, to allow the power supply assembly to supply power to the atomizer assembly 301 according to the triggering signal, to make the atomizer assembly 301 atomize the cigarette liquid. The capacitor C2 in the drawing is configured to supply power to the control chip U1 when short circuit occurs between two ends of the electric heating wire D, to allow the control chip U1 to have buffer time to close the field effect transistor Q1, thereby preventing a hazard situation from occurring. Apparently, the airflow sensing control module 110 may also be realized by a chip of other model types and an auxiliary circuit, and the circuit structure is not limited herein.

In this embodiment, by arranging the airflow sensing control module 110 inside the first electrode connector 104, the efficient of assembling the electronic cigarette may be effectively improved and the maintenance of the electronic cigarette is convenient.

It is to be noted that, this embodiment is described by taking the airflow sensing control module 110 arranged in the first electrode connector 104 in the first arc-shaped segment 101 as an example, the position of the airflow sensing control module 110 is not limited herein, as long as the airflow sensing control module 110 can control the power supply assembly to supply power to the atomizer assembly 301. For example, the airflow sensing control module 110 may also be arranged inside the connecting block 100, or inside the second arc-shaped segment 102.

Figure 5:
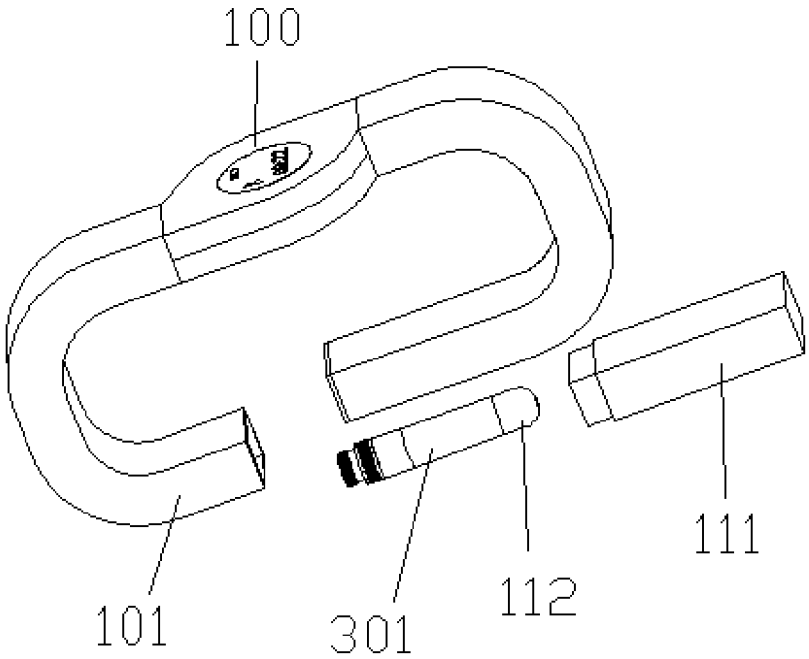
FIG. 5 is a schematic partially exploded view showing the structure of another preferred embodiment of the electronic cigarette according to the present application.

Further, in conjunction with FIGS. 2, 3 and 5, the end of the first arc-shaped segment 101 away from the connecting block 100 is provided with a first end cap 111, and the first end cap 111 is detachably connected to the first arc-shaped segment 101.

The specific method for connecting the first end cap 111 to the first arc-shaped segment 101 is not limited in this embodiment. For example, an end of the atomizing sleeve 105 away from the connecting block 100 may be provided with outer screw threads, and inner screw threads for cooperating with the outer screw threads may be provided on an inner side of the first end cap 111, thus the inner screw threads of the first end cap 111 can be screwed to the outer screw threads of the atomizing sleeve 105. Further, for example, a mounting groove may be arranged at the end of the atomizing sleeve 105 away from the connecting block 100. The first end cap 111 may be sleeved on the mounting groove, and is in interference fit with the mounting groove, thus when the user wishes to remove the atomizer assembly 301 from the first arc-shaped segment 101, the user can simply pull off the first end cap 111.

An end of the atomizer assembly 301 away from the second electrode connector 106 is provided with a suction nozzle 112 allowing the user to inhale smoke, that is, the user inhale smoke through the suction nozzle 112. The suction nozzle 112 and the atomizing sleeve 105 may be integrally formed or detachably connected, which is not limited herein.

Also, when the first end cap 111 is connected to the first arc-shaped segment 101, an end of the atomizer assembly 301 provided with the suction nozzle 112 extends out of the accommodating chamber of the first arc-shaped segment 101, and the suction nozzle 112 is accommodated in the first end cap 111.

In the electronic cigarette according to this embodiment, the suction nozzle 112 is accommodated in the first end cap 111, thus the user can conveniently remove the atomizer assembly 301 from the first arc-shaped segment 101, and the contamination of the suction nozzle 112 can be effectively avoided, which ensures the hygiene in using the electronic cigarette.

Further, referring to FIG. 2, the atomizer assembly further includes an air tube 113. The air tube 113 is inserted in the atomizing sleeve 105 with a gap therebetween, and is configured to allow the smoke to flow through. An end of the air tube 113 close to the suction nozzle 112 is in communication with an outer surface of the suction nozzle 112.

Preferably, the suction nozzle 112 according to this embodiment may be made of a metal material, which may avoid the phenomenon that the suction nozzle 112 is apt to fall off when a hard object, such as teeth of the mouth, clamps the suction nozzle 112. The metal material may be cooper, iron, steel, and etc., which is not limited herein.

The end of the air tube 113 close to the suction nozzle 112 is in communication with the outer surface of the suction nozzle 112, which may effectively ensure that smoke can flow to the suction nozzle 112 smoothly, to facilitate the user to inhale the smoke.

The liquid accommodating space 107 is located between the atomizing sleeve 105 and the air tube 113, and the liquid accommodating space 107 is isolated from the air tube 113, thereby preventing the cigarette liquid in the liquid accommodating space 107 from leaking into the air tube 113 to be accidentally sucked in by the user.

The atomizing chamber 114 is arranged at a side of the second electrode connector 106 in a direction towards the suction nozzle 112, the electric heating wire assembly is accommodated in the atomizing chamber 114, and the atomizing chamber 114 is in communication with the air tube 113.

The specific structure of the atomizing chamber 114 is not limited in this embodiment, as long as the atomizing chamber can accommodate the electric heating wire assembly to allow the atomizing chamber 114 to be in communication with the air tube 113.

Specifically, the electric heating wire assembly includes an electric heating wire configured to atomize the cigarette liquid and a liquid guiding wick configured to guide the cigarette liquid in the liquid accommodating space 107 to the electric heating wire.

More specifically, the electric heating wire located in the atomizing chamber 114 is wound around the liquid guiding wick, two ends of the liquid guiding wick pass through the atomizing chamber 114 to be inserted in the liquid accommodating space 107, thus the liquid guiding wick can deliver the cigarette liquid in the liquid accommodating space 107 to the electric heating wire.

Further, since the atomizing chamber 114 is in communication with the air tube 113, the smoke atomized by the electric heating wire located in the atomizing chamber 114 may be led to the suction nozzle 112 by passing through the atomizing chamber 114 and the air tube 113 in sequence, to allow the user to inhale the smoke by sucking the suction nozzle 112.

Further, the first electrode connector 104 includes a first outer electrode, a first insulating ring inserted in the first outer electrode, and a first inner electrode inserted in the first insulating ring. The first outer electrode and the first inner electrode are respectively electrically connected to a positive electrode and a negative electrode of the power supply assembly via the lead 109.

Figure 10:
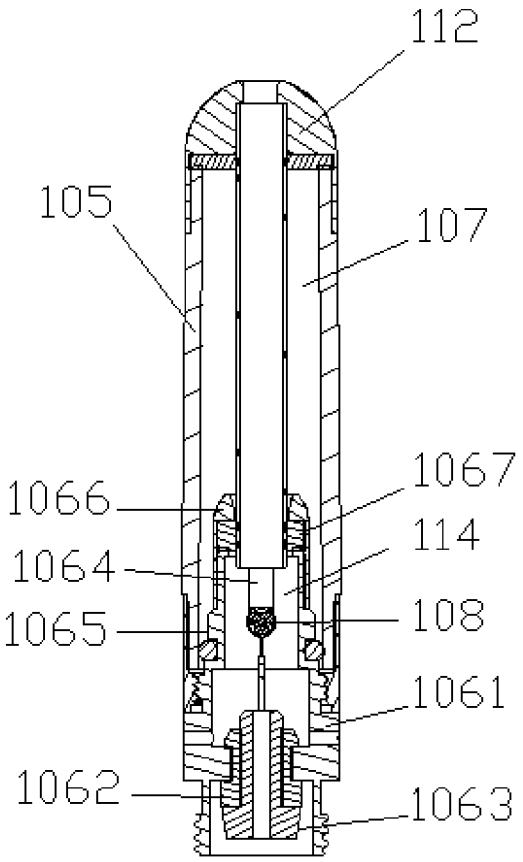
FIG. 10 is a schematic sectional view showing the structure of a preferred embodiment of an atomizer assembly according to the present application.
Figure 11:
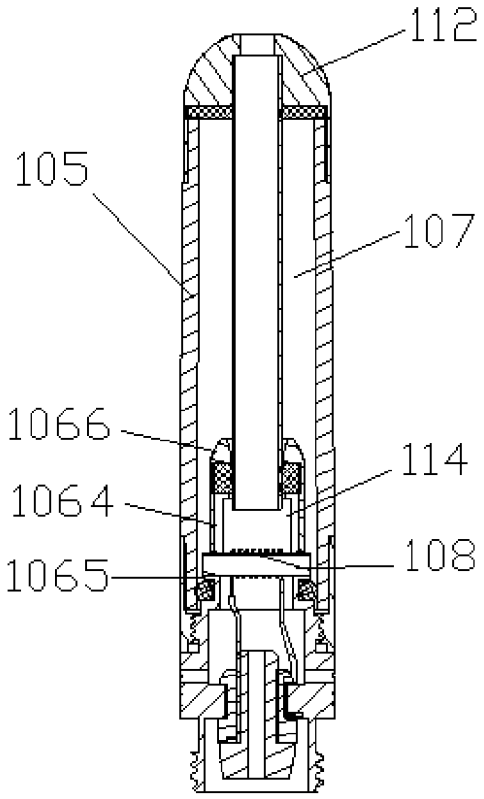
FIG. 11 is a schematic sectional view showing the structure of a preferred embodiment of the atomizer assembly according to the present application viewed in another angle.

Reference is made to FIGS. 10 and 11, the second electrode connector 106 includes a second outer electrode 1061, a second insulating ring 1062 inserted in the second outer electrode 1061, and a second inner electrode 1063 inserted in the second insulating ring 1062. The second outer electrode 1061 corresponds to the first outer electrode, and the second inner electrode 1063 corresponds to the first inner electrode. The electric heating wire in the electric heating wire assembly is electrically connected to the second outer electrode 1061 and the second inner electrode 1063, and the electric heating wire assembly is accommodated in the atomizing chamber 114 enclosed by the second outer electrode 1061. An end of the air tube 113 is inserted in the atomizing chamber 114.

An end of the second outer electrode 1061 located in the atomizing sleeve 105 is provided with two fixing grooves 1064 at opposite positions extending along an axial direction of the second outer electrode 1061. Each of the fixing grooves 1064 extends to an end surface and a side surface of the second outer electrode 1061 and is in communicated with the liquid accommodating space. An annular protrusion 1065 is arranged on an outer peripheral surface of the second outer electrode 1061 in a radial direction at a position corresponding to a bottom wall of the fixing groove 1064.

Two ends of the electric heating wire assembly are respectively inserted in the fixing grooves 1064, and a fixing cap 1066 is sleeved on an end of the second inner electrode 1061 located in the atomizing sleeve 105 and has an end abutting against the protrusion 1065. An end surface of the fixing cap 1066 further abuts against an end of the electric heating wire assembly. A portion of the protrusion 1065 located outside the bottom wall of the fixing groove 1064 abuts against the end of the electric heating wire assembly.

A sealing ring 1067 is sleeved on the air tube 113 and is accommodated in the fixing cap 1066, to prevent the cigarette liquid from leaking into the atomizing chamber 114. Since the fixing grooves 1064 extend to the end surface and the side surface of the second outer electrode 1061 and are in communication with the liquid accommodating space, which not only facilitates guiding the cigarette liquid, but also facilitates assembling the electric heating wire assembly. Since the protrusion 1065 abuts against the fixing cap 1066 and the electric heating wire assembly, the electric heating wire assembly will not be excessively pressed in assembling, and the electric heating wire assembly may be better fixed by the fixing cap 1066, to prevent the electric heating wire assembly from sliding into the atomizing chamber 114.

For enabling the atomizer assembly to be removed from the first arc-shaped segment 101 automatically, each of the first outer electrode and the second outer electrode is made of a magnetic material, and the first outer electrode and the second outer electrode magnetically repel each other, thus when the first end cap is disengaged from the first arc-shaped segment, the first outer electrode is subjected to a force in a direction away from the first arc-shaped segment, to allow the atomizer assembly to be disengaged from the first arc-shaped segment.

In another solution, each of the first outer electrode and the second outer electrode is provided with a respective magnetic block, and the magnetic block on the first outer electrode and the magnetic block on the second outer electrode magnetically repel each other, which enables the first outer electrode and the second outer electrode to magnetically repel each other, thus when the first end cap is disengaged from the first arc-shaped segment, the first outer electrode is subjected to a force in a direction away from the first arc-shaped segment, to allow the atomizer assembly to be disengaged from the first arc-shaped segment.

That is, when the first end cap 111 is detached from the first arc-shaped segment 101, the second outer electrode of the atomizer assembly is subjected to a force repelling the second outer electrode from the first outer electrode, to enable the atomizer assembly to be popped out of the first arc-shaped segment 101 automatically. Thus, when the user smokes, the user does not need to touch the atomizer by the hand, which effectively prevents the user's hand from being stained with the cigarette liquid, and effectively ensures the hygiene of the electronic cigarette.

In another solution, each of the first inner electrode and the second inner electrode is made of a magnetic material, and the first inner electrode and the second inner electrode magnetically repel each other, thus when the first end cap is disengaged from the first arc-shaped segment, the first inner electrode is subjected to a force in a direction away from the first arc-shaped segment, to allow the atomizer assembly to be disengaged from the first arc-shaped segment.

Or, each of the first inner electrode and the second inner electrode is provided with a respective magnetic block, and the magnetic block on the first inner electrode and the magnetic block on the second inner electrode magnetically repel each other, which enables the first inner electrode and the second inner electrode to magnetically repel each other, thus when the first end cap is disengaged from the first arc-shaped segment, the first inner electrode is subjected to a force in a direction away from the first arc-shaped segment, to allow the atomizer assembly to be disengaged from the first arc-shaped segment.

That is, when the first end cap 111 is detached from the first arc-shaped segment 101, the second inner electrode of the atomizer assembly is subjected to a force repelling the second inner electrode from the first inner electrode, to enable the atomizer assembly to be popped out of the first arc-shaped segment 101 automatically. Thus, when the user smokes, the user does not need to touch the atomizer by the hand, which effectively prevents the user's hand from being stained with the cigarette liquid, and effectively ensures the hygiene of the electronic cigarette.

For enabling the user to arrange the atomizer assembly at an optimized angle when the user smokes to improve the comfortableness of the user during the smoking process, the first arc-shaped segment 101 is made of a deformable material, and the first arc-shaped segment 101 can be bent to form any angle according to an operation of the user when the user smokes.

Figure 6:
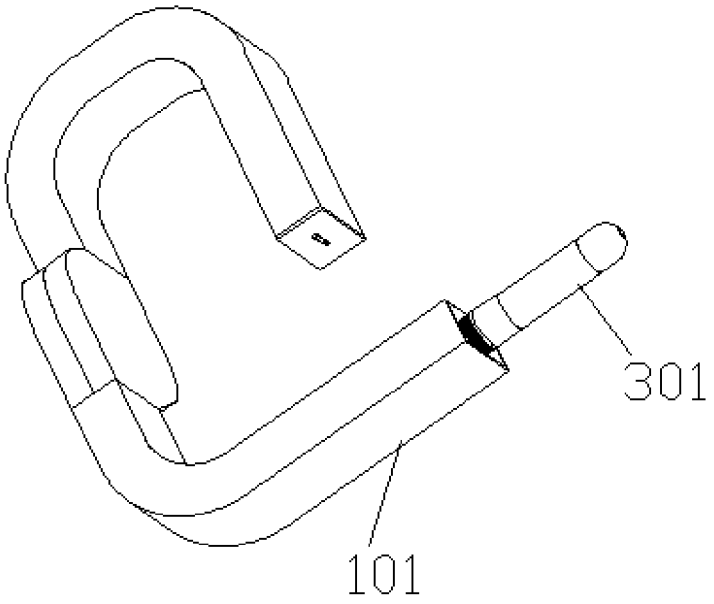
FIG. 6 is a schematic view showing the overall structure of another preferred embodiment of the electronic cigarette according to the present application.

Specifically, reference is made to FIG. 6, which shows that the atomizer assembly 301 is removed from the first arc-shaped segment 101, and the first arc-shaped segment 101 can be bent to form any angle according to the operation of the user.

The specific material of the first arc-shaped segment 101 is not limited in this embodiment, as long as it may be bent to form any angle according to the operation of the user.

Figure 7:
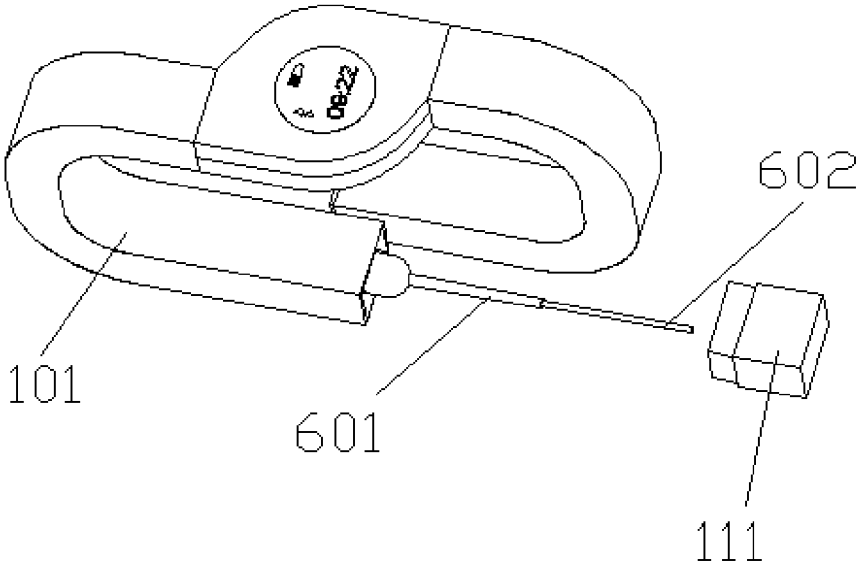
FIG. 7 is a schematic partially exploded view showing the structure of another preferred embodiment of the electronic cigarette according to the present application.

For further improving the convenience in smoking for the user, reference may be made to FIG. 7.

The air tube 113 includes multiple sub air tubes, which have sequentially decreased diameters and are nested into one another, hollow portions of the sub air tubes are in communication with each other, to allow adjacent two sub air tubes to be movable with respect to each other in an axial direction of the sub air tubes.

Respective ends of adjacent two sub air tubes are connected, and in the two interconnected sub air tubes, the sub air tube with a large diameter is a first target sub air tube, and the sub air tube with a small diameter is a second target sub air tube.

This embodiment is described by taking the number of the sub air tubes being two as an example, the number of the sub air tubes is not limited herein.

As shown in FIG. 7, a first flange is provided at an end, configured to be connected to the second target sub air tube 602, of the first target sub air tube 601. The first flange extends along a radial direction of the first target sub air tube 601 towards the interior of the first target sub air tube 601.

An end, configured to be connected to the first target sub air tube 601, of the second target sub air tube 602 is provided with a second flange. The second flange extends in a radial direction of the second target sub air tube 602 towards the interior of the second target sub air tube 602. Therefore, when the second target sub air tube 602 moves in the axial direction of the first target sub air tube 601 and in a direction away from the first arc-shaped segment, the second flange abuts against the first flange, to connect the end of the first target sub air tube 601 to the respective end of the second target sub air tube 602.

With such arrangement, there is no need to remove the atomizer assembly 301 from the first target sub air tube 601 when the user puffs on the electronic cigarette, and the user can simply remove the second target sub air tube 602 from the first target sub air tube 601 and enable the end of the first target sub air tube 601 to be connected to the respective end of the second target sub air tube 602. Since the first target sub air tube 601 and the second target sub air tube 602 are in communication with each other, the user may inhale the smoke directly through the second target sub air tube 602.

A specific structure of an electronic cigarette according to a third embodiment is described in detail, which has various functions.

Referring to FIGS. 2 and 3, the connecting block 100 is provided with an upper cover 302 and a lower cover 303 cooperating with each other, and the upper cover 302 and the lower cover 303 are combined to form an accommodating chamber of the connecting block 100.

A first control module is provided inside the accommodating chamber of the connecting block 100, and the first control module is electrically connected to the display module 103.

A through hole for receiving the display module 103 is provided in the upper cover 302 at a position corresponding to the display module 103.

A sensor 304 and a wireless communication module 305 which are electrically connected to the first control module are arranged in the accommodating chamber of the connecting block 100.

The specific number of each of the sensor 304 and the wireless communication module 305 is not limited in this embodiment.

The sensor 304 is configured to acquire a parameter, and the first control module is configured to transmit the parameter acquired by the sensor 304 to a mobile terminal through the wireless communication module 305.

The mobile terminal is configured to receive the parameter transmitted by the wireless communication module 305 to display the parameter.

The sensor 304 may be an acceleration sensor, and/or an electrocardiogram examination sensor, and/or a body temperature sensor.

If the sensor 304 is an acceleration sensor, it may acquire the velocity of the user during exercise, then the first control module can analysis the parameter transmitted by the acceleration sensor, to obtain the amount of exercise or the calories consumed by the user. Further, since the first control module is electrically connected to the display module 103, the result obtained by the first control module through analysis may be displayed by the display module 103, to allow the user to acquire the information about the amount of exercise of himself or the calories consumed by himself.

If the sensor 304 is an electrocardiogram examination sensor, the heartbeat situation of the user in normal life or during exercise may be acquired, and if an abnormal situation occurs, the first control module may enable the display module 103 to display the abnormal situation timely, to alert the user.

If the sensor 304 is a body temperature sensor, the body temperature situation of the user in normal life or during exercise may be acquired, and if an abnormal situation occurs, the first control module may enable the display module 103 to display the abnormal situation timely, to alert the user.

More specifically, the wireless communication module 305 may be a Bluetooth module for establishing a Bluetooth connection with a mobile terminal, and/or a wireless fidelity (WIFI) module for establishing a WIFI connection with a mobile terminal, and/or an near field communication (NFC) module for establishing an NFC connection with a mobile terminal, which is not limited in this embodiment.

Referring to FIGS. 2, 3 and 12, the first control module is further electrically connected to the airflow sensing control module, to acquire information, including smoking parameters of the user, from the airflow sensing control module, and enable the display module 103 to display the number of times of the user sucking the electronic cigarette. Specifically, each time the user sucks the electronic cigarette, the airflow sensing control module is initiated once. The specific operation principle of the airflow sensing control module may be referred to the foregoing descriptions, which will not be described again in this embodiment. Then the first control module counts the number of times of initiation of the airflow sensing control module, and determines the number of times of initiation of the airflow sensing control module as the number of times of sucking the electronic cigarette, and the first control module enables the display module 103 to display the number of times of the user sucking the electronic cigarette.

Or/and, the first control module determines the atomizing power of the atomizer assembly, and enables the display module 103 to display the atomizing power of the atomizing assembly.

Or/and, the first control module determines the smoking duration of the user, and enables the display module 103 to display the smoking duration.

Or/and, the first control module generates a smoking pattern graph, and the content displayed by the smoking pattern graph is regular events related to the smoking of the user which are determined by the first control module. The content is not limited in this embodiment, for example, the smoking pattern graph may show the number of times of sucking the electronic cigarette counted every preset period, for example, the number of times of the user sucking the electronic cigarette in January, and the number of times of the user sucking the electronic cigarette in February. Further, for example, the smoking pattern graph may show the distribution situation of the smoking time of the user, such as the number of times of the user smoking in the morning, and the number of times of the user smoking in the afternoon, and etc.

Specifically, when the user smokes, the airflow sensor M1 transmits the smoking signal to the control chip U1, then the control chip U1 may record the number of times of the user sucking the electronic cigarette and the smoking time of the user according to the smoking signal, and transmit the number of times of sucking the electronic cigarette and the smoking time to the first control module, the first control module acquires information of the number of times of sucking the electronic cigarette and the smoking time, and obtains the smoking pattern of the user according to this information, therefore the number of times of sucking the electronic cigarette, the smoking time, and the smoking pattern may be displayed on the display module in the form of a graph, to allow the user to know about the smoking condition of himself.

Furthermore, the control chip U1 may be embodied as a chip with an analog-to-digital conversion module to direct read the voltage of the electric heating wire D, thus may conveniently estimate the atomizing power of the atomizing assembly, and enable the display module to display the atomizing power. Apparently, in another solution, the first control module is electrically connected to the display module 103 and the atomizer assembly, and the display module 103 is configured to display information such as the number of times of the user sucking the electronic cigarette, or/and the atomizing power of the atomizer assembly, or/and the smoking time of the user, or/and the smoking pattern graph. For example, the first control module may be provided with a micro processor for controlling the display module, and the micro processor is electrically connected to the electric heating wire D. When the user is smoking, the control chip U1 controls the field effect transistor Q1 to be switched on, to allow the battery in the power supply assembly to supply power to the electric heating wire D of the atomizer assembly 301, then the micro processor may acquire information regarding the electronic cigarette and the user, such as the smoking time of the user, and the number of times of the user sucking the electronic cigarette, and control the display module to display the information such as the smoking time, and the number of times of sucking the electronic cigarette.

Apparently, the above functions achieved by the electronic cigarette are only described as examples, and are not intended to constitute limitation. For example, the first control module may further determine a current time, and enable the display module 103 to display the current time, thereby allowing the electronic cigarette according to this embodiment to further function as an electronic watch. The first control module may further be arranged in the first arc-shaped segment 101 or be integrated with the airflow sensing control module.

Preferably, the power supply assembly is a lithium power supply, and the power supply assembly is arranged in the accommodating chamber of the connecting block 100.

Figure 8:
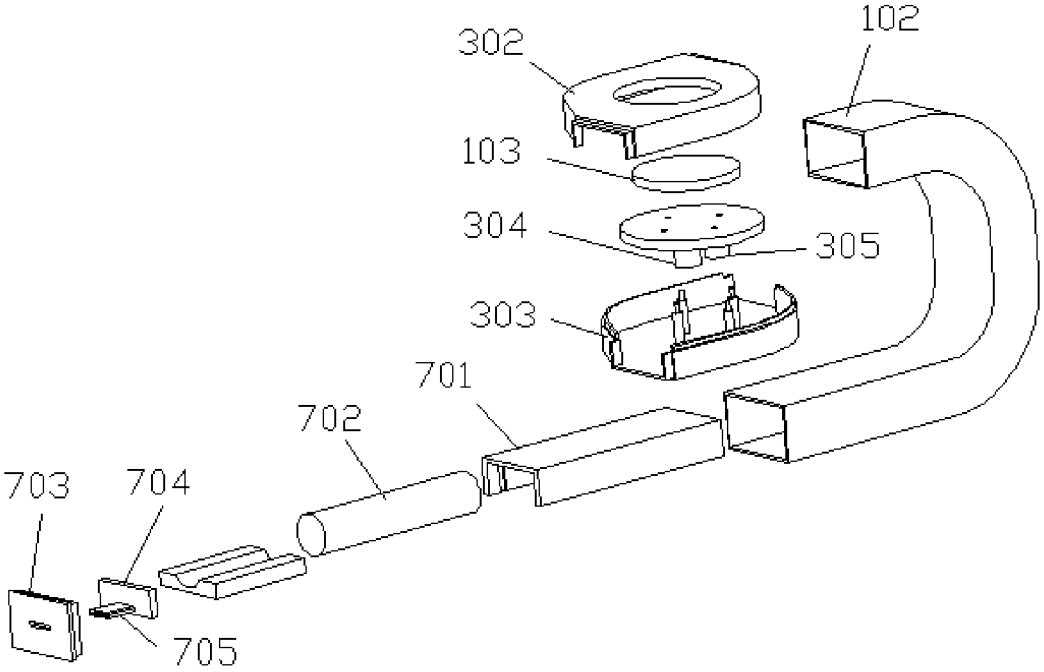
FIG. 8 is a schematic partially exploded view showing the structure of another preferred embodiment of the electronic cigarette according to the present application.
Figure 9:
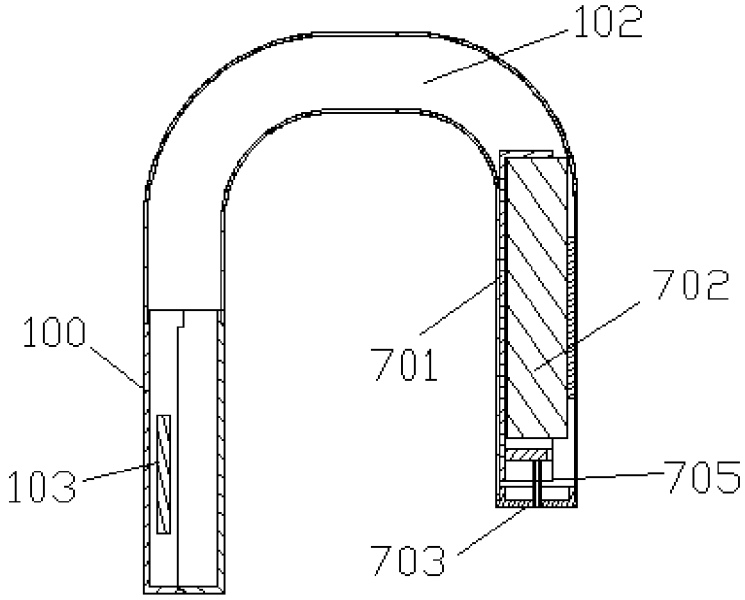
FIG. 9 is a schematic partially sectional view showing the structure of another preferred embodiment of the electronic cigarette according to the present application.

In another solution, as shown in FIGS. 8 and 9, a holder 701 is provided in the accommodating chamber of the second arc-shaped segment 102, and the power supply assembly 702 is fixedly arranged in the accommodating chamber of the second arc-shaped segment 102 via the holder 701.

The specific structure of the holder 701 is not limited in this embodiment, as long as the holder 701 is capable of fixing the power supply assembly 702.

More specifically, the first control module is provided inside the accommodating chamber of the connecting block 100 and is electrically connected to the display module 103, and the first control nodule is further electrically connected to the power supply assembly, and is further configured to acquire the remaining capacity of the power supply assembly, thus the first control module can enable the display module 103 to display the remaining capacity.

Further, for example, as shown in FIGS. 1, 8 and 9, an end of the second arc-shaped segment 102 away from the connecting block 100 is provided with a second end cap 703, and the second end cap 703 is detachably connected to the second arc-shaped segment 102.

The specific method of the detachable connection is not limited in this embodiment, for example, an outer peripheral surface of the second end cap 703 is provided with outer screw threads, and an inner peripheral surface of the second arc-shaped segment 102 is provided with inner screw threads cooperating with the outer screw threads, thus the outer screw threads of the second end cap 703 can be screwed to the inner screw threads of the second arc-shaped segment 102.

A second control module 704 is provided in the accommodating chamber of the second arc-shaped segment 102, and a universal serial bus (USB) interface 705 is electrically connected to the second control module 704.

The second end cap 703 is provided with a through hole for receiving the USB interface 705.

The second control module 704 is electrically connected to the first control module, and is configured to acquire, via the first control module, the parameter acquired by the sensor 304. The second control module 704 is connected to the mobile terminal via the USB interface 705 and a data line, to allow the second control module 704 to transmit the acquired parameter to the mobile terminal via the USB interface 705 and the data line.

And/or, the second control module 704 is electrically connected to the power supply assembly, and is electrically connected to an external power supply via the USB interface 705 and the data line, thus the second control module 704 can use the external power supply to charge the power supply assembly.

The electronic cigarette described in this embodiment may achieve multiples functions, thereby improving the diversities of the functions of the electronic cigarette, avoiding the disadvantage of the electronic cigarette with single function, and increasing the attraction of the electronic cigarette to the user. Furthermore, since the electronic cigarette may be carried around, the user can check information anytime and anywhere via the electronic cigarette, such as parameters of his own body, the time, and the residual quantity of the cigarette liquid, which is extremely convenient for the user, and improves the attraction of the product to the user.

It may be clearly acknowledged by the person skilled in the art that, for convenience and simplicity of description, the specific working processes of the system, device and unit described above are not described herein, and can be referred to the corresponding process in the embodiments of the method described above.

The above embodiments are only intended for describing the technical solutions of the present application, and should not be interpreted as limitation to the present application. Although the present application is described in detail in conjunction with the above embodiments, it should be understood that, for those skilled in the art, modifications may be made to the technical solutions of the above embodiments, or equivalent substitutions may be made to part of the technical features in the technical solutions; and theses modifications and substitutions do not make the essence of the corresponding technical solutions depart from the spirit and scope of the technical solutions of embodiments of the present application.

The invention claimed is:

1. An electronic cigarette, comprising: an annular body configured to be worn on a wrist of a user, wherein the annular body comprises an atomizer assembly, a power supply assembly, a connecting block, a first arc-shaped segment and a second arc-shaped segment which are arranged respectively at two ends of the connecting block and are configured to undergo elastic deformation under the action of an external force, and the connecting block is provided with a display module;

an accommodating chamber in communication with an end surface of the first arc-shaped segment is provided in the first arc-shaped segment, a first electrode connector electrically connected to the power supply assembly is provided in the first arc-shaped segment, the atomizer assembly and the first electrode connector are detachably connected to each other, and the atomizer assembly is inserted in the accommodating chamber of the first arc-shaped segment with a gap between the accommodating chamber and the atomizer assembly, the first electrode connector is inserted in the accommodating chamber of the first arc-shaped segment with a gap between the accommodating chamber and the first electrode connector, and the first electrode connector and the atomizer assembly are sequentially arranged in an extending direction of the first arc-shaped segment; and the atomizer assembly comprises an atomizing sleeve, a second electrode connector arranged at an end of the atomizing sleeve and electrically connected to the first electrode connector, a liquid accommodating space arranged in the atomizing sleeve, and an electric heating wire assembly configured to atomize cigarette liquid stored in the liquid accommodating space to form smoke, and the electric heating wire assembly is electrically connected to the second electrode connector.

2. The electronic cigarette according to claim 1, wherein the first electrode connector is detachably accommodated in the accommodating chamber of the first arc-shaped segment, and the first electrode connector is electrically connected to the power supply assembly via a lead curled and received in the accommodating chamber of the first arc-shaped segment, to allow the first electrode connector to be removable from the accommodating chamber of the first arc-shaped segment together with the atomizer assembly; and an airflow sensing control module is provided in the first electrode connector, and is configured to control the power supply assembly to supply power to the atomizer assembly in the case that it is sensed by the airflow sensing control module that the user is puffing on the electronic cigarette.

3. The electronic cigarette according to claim 1, wherein an end of the first arc-shaped segment away from the connecting block is provided with a first end cap, and the first end cap is detachably connected to the first arc-shaped segment; and an end of the atomizer assembly away from the second electrode connector is provided with a suction nozzle for inhaling smoke, the end of the atomizer assembly provided with the suction nozzle extends out of the accommodating chamber of the first arc-shaped segment, and the suction nozzle is received in the first end cap.

4. The electronic cigarette according to claim 3, wherein the atomizer assembly further comprises an air tube, the air tube is inserted into the atomizing sleeve with a gap between the air tube and the atomizing sleeve, and is configured to allow the smoke to flow through, and an end of the air tube close to the suction nozzle is in fluid communication with an outer surface of the suction nozzle;

the liquid accommodating space is located between the atomizing sleeve and the air tube; and an atomizing chamber is arranged at a side of the second electrode connector in a direction towards the suction nozzle, the electric heating wire assembly is received in the atomizing chamber, and the atomizing chamber is in fluid communication with the air tube.

5. The electronic cigarette according to claim 2, wherein an end of the first arc-shaped segment away from the connecting block is provided with a first end cap, and the first end cap is detachably connected to the first arc-shaped segment; and an end of the atomizer assembly away from the second electrode connector is provided with a suction nozzle for inhaling smoke, the end of the atomizer assembly provided with the suction nozzle extends out of the accommodating chamber of the first arc-shaped segment, and the suction nozzle is received in the first end cap.

6. The electronic cigarette according to claim 5, wherein the atomizer assembly further comprises an air tube, the air tube is inserted into the atomizing sleeve with a gap between the air tube and the atomizing sleeve, and is configured to allow the smoke to flow through, and an end of the air tube close to the suction nozzle is in fluid communication with an outer surface of the suction nozzle;

the liquid accommodating space is located between the atomizing sleeve and the air tube; and an atomizing chamber is arranged at a side of the second electrode connector in a direction towards the suction nozzle, the electric heating wire assembly is received in the atomizing chamber, and the atomizing chamber is in fluid communication with the air tube.

7. The electronic cigarette according to claim 1, wherein the first electrode connector comprises a first outer electrode, a first insulating ring inserted in the first outer electrode and a first inner electrode inserted in the first insulating ring;

the second electrode connector comprises a second outer electrode, a second insulating ring inserted in the second outer electrode, and a second inner electrode inserted in the second insulating ring; and each of the first outer electrode and the second outer electrode is made of a magnetic material or is provided with a respective magnetic block, and the first outer electrode and the second outer electrode magnetically repel each other, to allow the first outer electrode to be subjected to a force in a direction away from the first arc-shaped segment in the case that a first end cap is disengaged from the first arc-shaped segment, to allow the atomizer assembly to be disengaged from the first arc-shaped segment;

or, each of the first inner electrode and the second inner electrode is made of a magnetic material or is provided with a respective magnetic block, and the first inner electrode and the second inner electrode magnetically repel each other, to allow the first inner electrode to be subjected to a force in a direction away from the first arc-shaped segment in the case that a first end cap is disengaged from the first arc-shaped segment, to allow the atomizer assembly to be disengaged from the first arc-shaped segment.

8. The electronic cigarette according to claim 1, wherein the first arc-shaped segment is made of a deformable material, and is configured to be bent to form any angle according to an operation of the user when the user smokes.

9. The electronic cigarette according to claim 4, wherein the air tube comprises a plurality of sub air tubes, which have sequentially decreased diameters and are nested into one another, and hollow portions of all the sub air tubes are in communication with each other, to allow adjacent two sub air tubes to be movable with respect to each other in an axial direction of the sub air tubes;

respective ends of adjacent two sub air tubes are configured to be connected, and in two interconnected sub air tubes, the sub air tube with a large diameter is a first target sub air tube, and the sub air tube with a small diameter is a second target sub air tube;

a first flange is provided at an end, configured to be connected to the second target sub air tube, of the first target sub air tube, and the first flange extends along a radial direction of the first target sub air tube towards the interior of the first target sub air tube; and an end, configured to be connected to the first target sub air tube, of the second target sub air tube is provided with a second flange, the second flange extends in a radial direction of the second target sub air tube towards the interior of the second target sub air tube, and the second flange is configured to abut against the first flange in the case that the second target sub air tube moves in the axial direction of the first target sub air tube and in a direction away from the first arc-shaped segment, to connect respective ends of the first target sub air tube and the second target sub air tube.

10. The electronic cigarette according to claim 1, wherein the connecting block is provided with an upper cover and a lower cover cooperating with each other, and the upper cover and the lower cover are configured to be combined to form an accommodating chamber of the connecting block;

a first control module is provided in the accommodating chamber of the connecting block, and the first control module is electrically connected to the display module;

a through hole configured to receive the display module is provided in the upper cover at a position corresponding to the display module;

a sensor and a wireless communication module are arranged in the accommodating chamber of the connecting block and are electrically connected to the first control module; and the sensor is configured to acquire a parameter, and the first control module is configured to transmit the parameter acquired by the sensor to a mobile terminal by the wireless communication module.

11. The electronic cigarette according to claim 10, wherein the sensor is an acceleration sensor, and/or an electrocardiogram examination sensor, and/or a body temperature sensor;

the first control module is configured to acquire the parameter acquired by the acceleration sensor, and/or the electrocardiogram examination sensor, and/or the body temperature sensor, and the first control module is further configured to enable the display module to display the parameter; and the wireless communication module is a Bluetooth module for establishing a Bluetooth connection with the mobile terminal, and/or a wireless fidelity (WIFI) module for establishing a WIFI connection with the mobile terminal, and/or a near field communication (NFC) module for establishing an NFC connection with the mobile terminal.

12. The electronic cigarette according to claim 10, wherein an end of the second arc-shaped segment away from the connecting block is provided with a second end cap, and the second end cap is detachably connected to the second arc-shaped segment; a second control module is provided in an accommodating chamber of the second arc-shaped segment, and a universal serial bus (USB) interface is provided and is electrically connected to the second control module;

the second end cap is provided with a through hole for receiving the USB interface;

the second control module is electrically connected to the first control module, and is configured to acquire, via the first control module, the parameter acquired by the sensor, and the second control module is connected to the mobile terminal via the USB interface and a data line, to allow the second control module to transmit the acquired parameter to the mobile terminal via the USB interface and the data line;

and/or, the second control module is electrically connected to the power supply assembly, and the second control module is electrically connected to an external power supply via the USB interface and the data line, to allow the second control module to enable the external power supply to charge the power supply assembly.

13. The electronic cigarette according to claim 11, wherein an end of the second arc-shaped segment away from the connecting block is provided with a second end cap, and the second end cap is detachably connected to the second arc-shaped segment; a second control module is provided in an accommodating chamber of the second arc-shaped segment, and a universal serial bus (USB) interface is provided and is electrically connected to the second control module;

the second end cap is provided with a through hole for receiving the USB interface;

the second control module is electrically connected to the first control module, and is configured to acquire, via the first control module, the parameter acquired by the sensor, and the second control module is connected to the mobile terminal via the USB interface and a data line, to allow the second control module to transmit the acquired parameter to the mobile terminal via the USB interface and the data line;

and/or, the second control module is electrically connected to the power supply assembly, and the second control module is electrically connected to an external power supply via the USB interface and the data line, to allow the second control module to enable the external power supply to charge the power supply assembly.

14. The electronic cigarette according to claim 1, wherein the power supply assembly is a lithium power supply, and is arranged in an accommodating chamber of the connecting block;

or, a holder is provided in an accommodating chamber of the second arc-shaped segment, and the power supply assembly is fixedly arranged in the accommodating chamber of the second arc-shaped segment via the holder.

15. The electronic cigarette according to claim 14, wherein a first control module is provided in the accommodating chamber of the connecting block, and is electrically connected to the display module; and the first control nodule is further electrically connected to the power supply assembly, and is further configured to acquire a residual capacity of the power supply assembly, and the first control module is configured to enable the display module to display the residual capacity.

16. The electronic cigarette according to claim 2, wherein the electronic cigarette is further provided with a first control module, and the first control module is electrically connected to the display module and the airflow sensing control module, the first control module is configured to control the display module to display the number of times of the user sucking the electronic cigarette, or/and an atomizing power of the atomizer assembly, or/and a smoking time of the user, or/and a smoking pattern graph.

17. The electronic cigarette according to claim 1, wherein an end of the first arc-shaped segment away from the connecting block is provided with a first magnet, and an end of the second arc-shaped segment away from the connecting block is provided with a second magnet configured to be connected to the first magnet by magnetic attraction, to allow the electronic cigarette to be worn on the wrist of the user or removed from the wrist of the user by the detachable connection between the first magnet and the second magnet.

18. The electronic cigarette according to claim 1, wherein in the case that the electronic cigarette is worn on the wrist of the user, the end of the first arc-shaped segment away from the connecting block and the end of the second arc-shaped segment away from the connecting block are in parallel with each other and are fitting close to the wrist of the user.

19. The electronic cigarette according to claim 18, wherein in the case that the electronic cigarette is worn on the wrist of the user, an end surface of the end of the first arc-shaped segment away from the connecting block abuts against an end surface of the end of the second arc-shaped segment away from the connecting block; or a side surface, perpendicular to an extending direction of a hand of the user, of the end of the first arc-shaped segment away from the connecting block abuts against a side surface, perpendicular to the extending direction of a hand of the user, of the end of the second arc-shaped segment away from the connecting block.

20. The electronic cigarette according to claim 1, wherein the second electrode connector comprises a second outer electrode, a second insulating ring inserted in the second outer electrode, and a second inner electrode inserted in the second insulating ring, the electric heating wire assembly is electrically connected to the second outer electrode and the second inner electrode, and the electric heating wire assembly is received in an atomizing chamber enclosed by the second outer electrode;

an end of the second outer electrode located inside the atomizing sleeve is provided with two fixing grooves at opposite positions extending along an axial direction of the second outer electrode, each of the fixing grooves extends to an end surface and a side surface of the second outer electrode and is in fluid communication with the liquid accommodating space, and an annular protrusion is provided on an outer peripheral surface of the second outer electrode in a radial direction at a position corresponding to a bottom wall of the fixing grooves; and two ends of the electric heating wire assembly are respectively inserted in the fixing grooves, and a fixing cap is sleeved on an end of the second inner electrode located inside the atomizing sleeve and has an end configured to abut against the protrusion, an end surface of the fixing cap is configured to abut against an end of the electric heating wire assembly, and a portion of the protrusion located outside the bottom wall of the fixing grooves is configured to abut against the end of the electric heating wire assembly.

* * * * *